US007517273B2

(12) United States Patent
Wooten

(10) Patent No.: US 7,517,273 B2
(45) Date of Patent: Apr. 14, 2009

(54) SUPPORT BRA

(76) Inventor: Andrea Wooten, 5915 Flintlock #902, Houston, TX (US) 77040

( * ) Notice: Subject to any disclaimer, the term of this patent is extended or adjusted under 35 U.S.C. 154(b) by 0 days.

(21) Appl. No.: 11/477,138

(22) Filed: Jun. 28, 2006

(65) Prior Publication Data

US 2007/0037482 A1 Feb. 15, 2007

Related U.S. Application Data

(63) Continuation-in-part of application No. 10/732,707, filed on Dec. 10, 2003, now abandoned.

(51) Int. Cl.
*A41C 3/00* (2006.01)
*A41C 3/12* (2006.01)

(52) U.S. Cl. ..... 450/63; 450/59; 450/60

(58) Field of Classification Search ..... 450/39–44, 450/59, 60, 63, 67, 68, 78
See application file for complete search history.

(56) References Cited

U.S. PATENT DOCUMENTS 2,421,448 A * 6/1947 Witkower ..... 450/63
6,406,351 B1 * 6/2002 Chen ..... 450/55

* cited by examiner

*Primary Examiner*—Gloria Hale
(74) *Attorney, Agent, or Firm*—Delphine James

(57) ABSTRACT

The present Invention provides a breast support apparatus. The apparatus further comprises at least one layered front portion constructed to form two breast cups. Each breast cup is configured and dimensioned to hold a female breast. Attached to each breast cup is a support member made of a strong flexible rigid material that is configured and dimensioned to accommodate at least the lower section of each breast cup. The back portion includes an inner layer made of a foam material that molds to the shape of the body during movement. At least one cooperating fastening members is attached to the internal peripheral edge proximately near the mid-section of each breast cup such that when the cooperating fastening members are secured the support member uplifts each breast.

14 Claims, 5 Drawing Sheets

SUPPORT BRA

The present application is a Continuation-IN-Part application of patent application Ser. No. 10/732,707, filed on Dec. 10, 2003, now abandoned.

BACKGROUND

This invention relates to bras and more particularly, a support bra. Under wire support bras are known in the art. However, for heavy breasted women an under wire bra does not provide adequate support, thereby causing heavy busted women to sag which is obvious in appearance beneath the clothing. Therefore, the under wire bra does not provide the reshaping necessary for a more aesthetically pleasing appearance. Additionally, the underwire bra does not assist in the back support. The problems identified here are not intended to be exhaustive but rather are to illustrate why an improved support bra is needed.

SUMMARY

In accordance with one aspect of the present invention, there is provided a breast support apparatus. The present support apparatus includes a front portion constructed to form breast cups and a back portion constructed from at least one continuous layer of material. In one embodiment, the back portion can contain an inner layer constructed from foam that molds to the shape of the body during movement. In an alternative embodiment, the back portion can contain a plurality of pressure points made from foam the molds to the shape of the body during movement. Attached to the outer lower surface area of each breast cup is a support member made of a strong flexible rigid material. In alternative embodiments the support member can be attached to the inner surface area of each breast cup. When the each breast cup is securely fastened together, the support member uplifts each breast for a more aesthetically pleasing appearance.

DETAILED SPECIFICATION

Definition—pressure point is a pocket of foam material to support the pressure areas of the upper area of the back.

Figure 1:
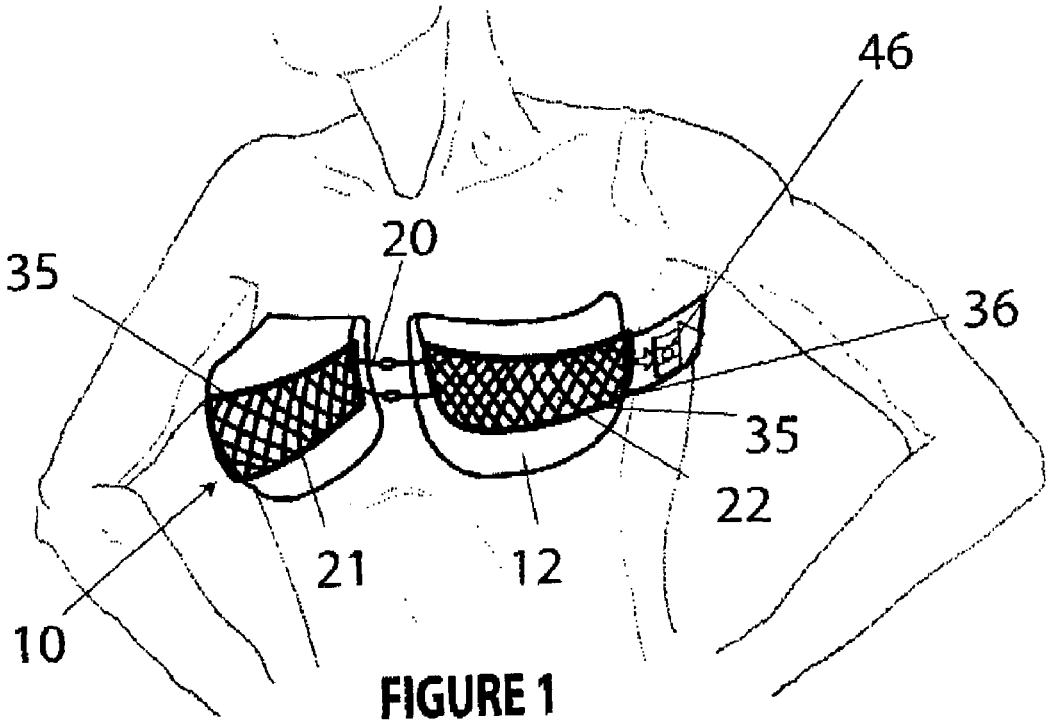
FIG. 1 is a front view of the support bra having the support member externally mounted upon each breast cup.
Figure 1A:
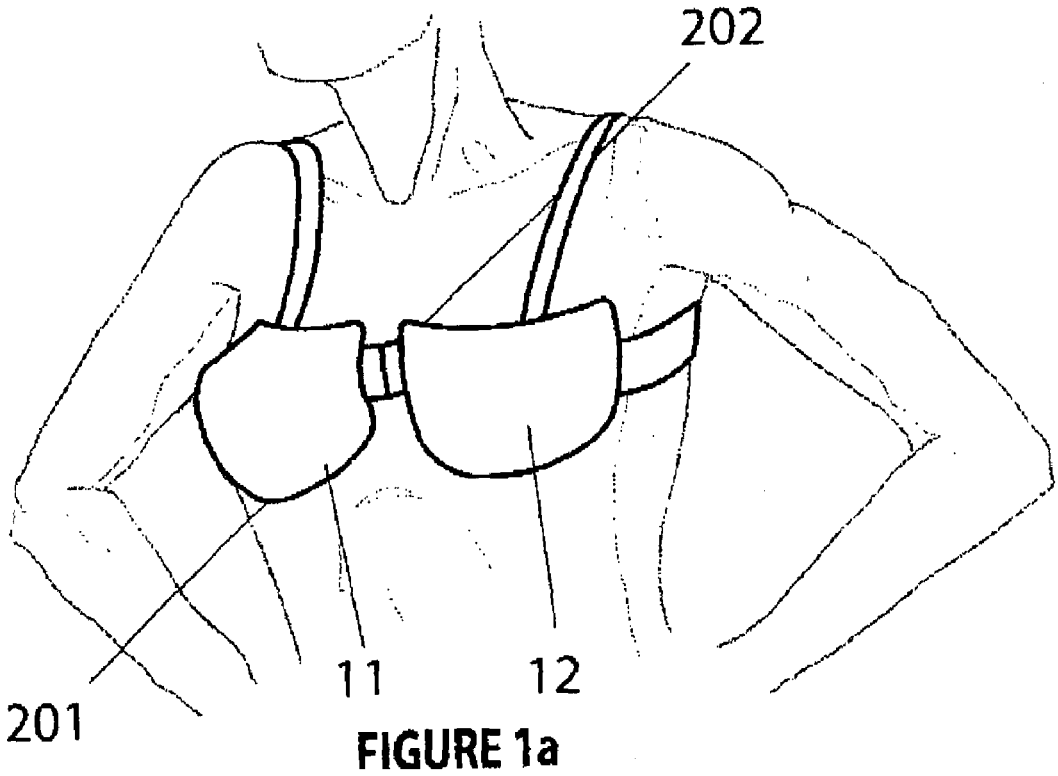
FIG. 1*a*- Shows the brassiere cups with cooperating fastening members on complementary extending flanges attached to the inner peripheral edges of each breast cup.

Referring to FIG. 1, there is shown a front view of one embodiment of the present invention a strapless support bra (10) illustrated in the manner in which it is to be worn. Support bra (10) further includes at least one layered front portion constructed to form two breast cups (11, 12) connected by cooperating fastening means (20). As depicted in FIG. 1A, cooperating fastening members (20) further comprises complementary extending flanges (201, 202) attached to the inner peripheral edge of the mid-section of each breast cup (11, 12). Attached to each complementary flange is a conventional fastener such as hooks or snaps. Each breast cup (11, 12) can be made of at least one layer of foam material or another suitable material. Additionally, each breast cup (11, 12) can be contoured to support heavy busted women.

Figure 2:
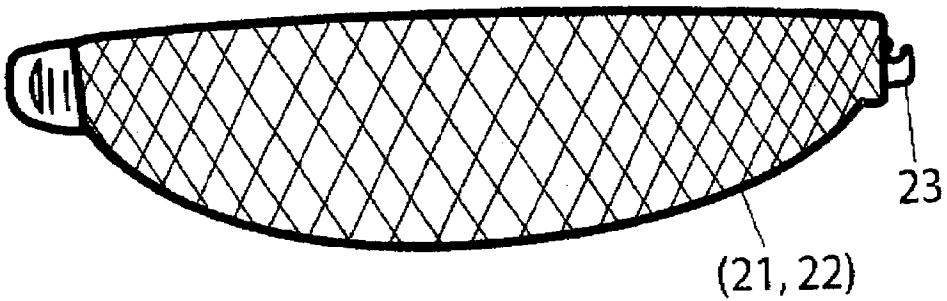
FIG. 2 is an exploded view of the support member.

As depicted in FIG. 1, support bra (10) further comprises corresponding support member (21, 22) for each breast cup (11, 12). Support member (21, 22) are preferably cut in a semi-circular shape as shown in FIG. 2. Each support member (21, 22) can also be contoured and constructed to support heavy busted women. Support members (21, 22) can be made of a strong flexible wire or plastic mesh as shown in FIG. 2. In alternative embodiments, support member (21, 22) can be made of strong flexible plastic. The support member (21, 22) can also be made of a durable lightweight plastic material.

Figure 1B:
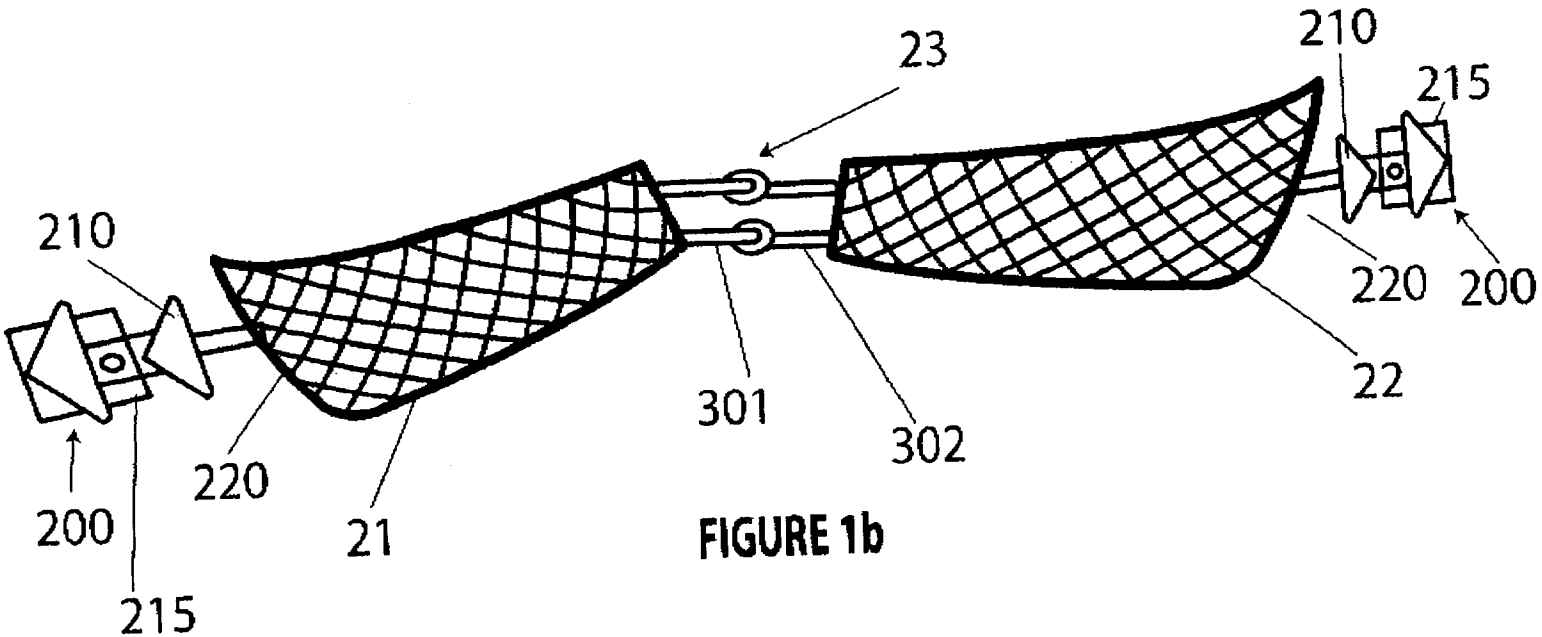
FIG. 1*b* shows the complementary fasteners extending from complementary flanges on the mid-section of each cup.
Figure 1C:
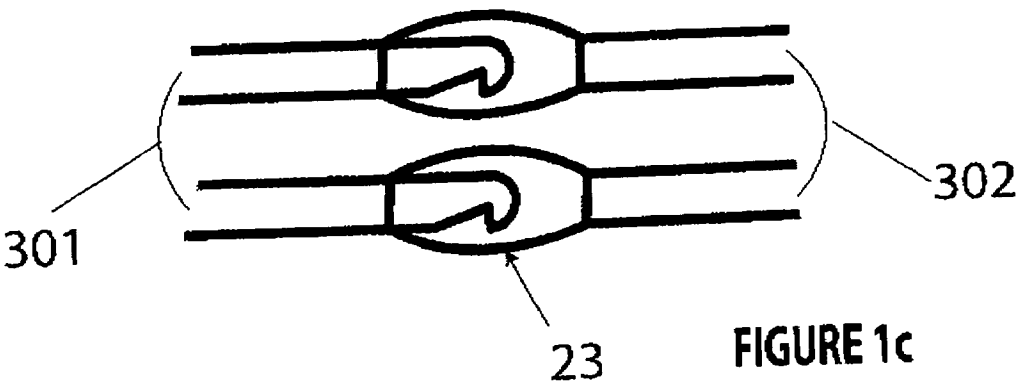
FIG. 1*c*- shows a close-up view of the fastener attached to each complementary flange at the peripheral edges of each cup.

As depicted in FIG. 1, each support member (21, 22) is secured in place upon the lower external surface area of each breast up (11, 12). As shown, each support member (21, 22) spans the lower external surface area of each breast cup (11, 12) and is secured in place upon using a second cooperating fastening member (23). As depicted in FIG. 1B, cooperating fastening members (23) further comprises complementary extending flanges (301, 302) attached to the inner peripheral edge of the mid-section of each support member. As depicted in FIG. 1C, attached to each complementary flange (301, 302) is a conventional fastener such as hooks or snaps. In this embodiment, support member (21, 22) can be secured in place upon the external surface area using adhesive, sewing, hook and eye such as VELCRO or another suitable fastening means. In other embodiments, support member can be secured in place utilizing adjustable members or the drawstring mechanism further described below.

The first side edge of the back portion is attached to the first side edge of a first breast cup and the opposing second side edge of the back portion is attached to the side edge of the second breast cup. Each support member has an outer peripheral edge with an adjustable means attaching the outer peripheral edge of each support member to the opposing side edge of each back portion such that the support member is adjustable to the beast size and shape of the wearer.

Figure 3:
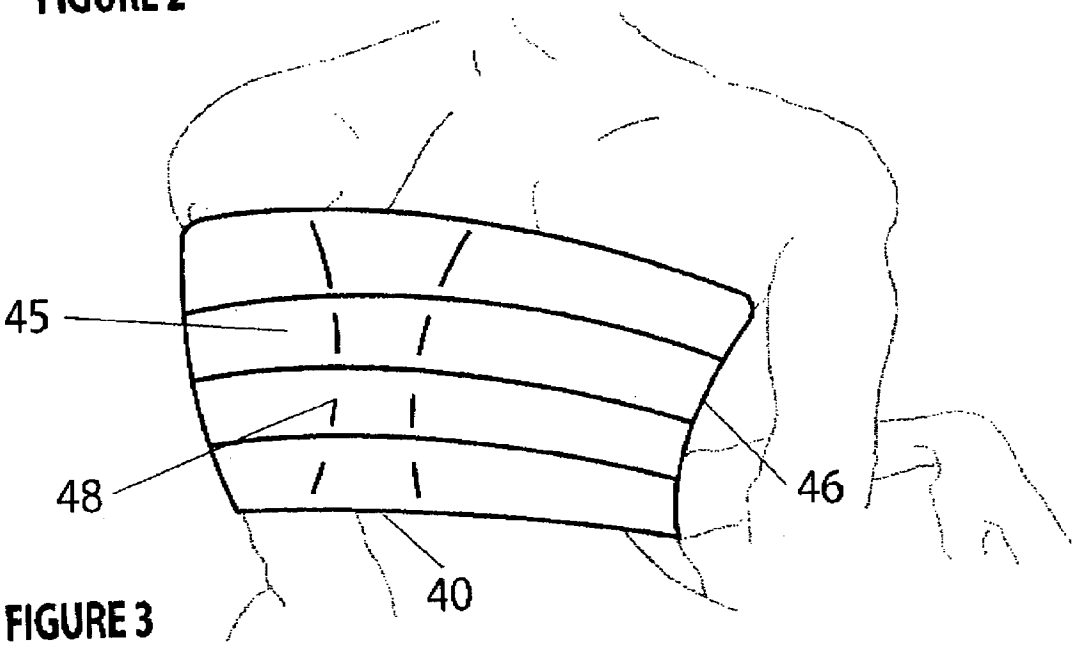
FIG. 3 is a back view of the support bra.

As depicted in FIG. 3, support bra (10) further comprises back portion (40) having opposing sides (45, 46). As shown FIG. 1, each opposing side edge (45, 46) of back portion (40) integrates into front portion and attaches to each side edge (36) of breast cup (11, 12).

Back portion (40) can be made of at least one layer of fabric material such as polyester Or another suitable type of fabric.

In other embodiments, back portion further includes a continuous inner layer of a foam material that molds to the shape of the wearer's body during movement. The foam material can be visco-elastic "memory foam" or another suitable type of foam material. As depicted in FIG. 3, stitching (48) across the middle of the back area to secure the foam material in place.

Figure 4:
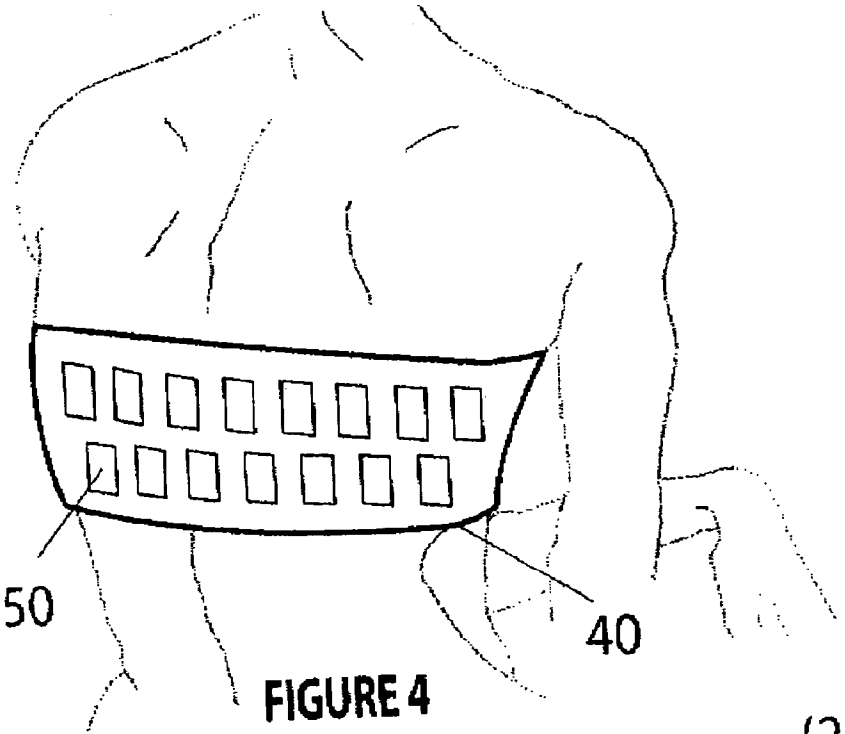
FIG. 4 illustrates an alternative embodiment of the back portion of the support bra.

In alternative embodiments, as shown in FIG. 4, back portion (40) can comprise a plurality of small pressure points (50) spanning the, entire surface area. Each pressure point (50) can be made of a foam material such as visco-elastic memory foam or another suitable type of foam material. As shown each pressure point can consist of a small pocket of foam. Thus, the plurality of small pressure points (50) consists of a plurality of pockets of foam spanning the back portion.

In alternative embodiments, breast cup (11, 12) can further include an inner padding constructed and dimensioned to the size of each breast cup (11, 12). The padding can be made of a foam material that molds to the shape of the wearer's body during movement. The foam material can be visco-elastic "memory foam" or another suitable type of foam material. In even some more specific embodiments, support member (21, 22) can be constructed to be inserted within breast cup (21, 22) sandwiched between the external layer and the padding of each breast cup (11, 12)

Figure 5:
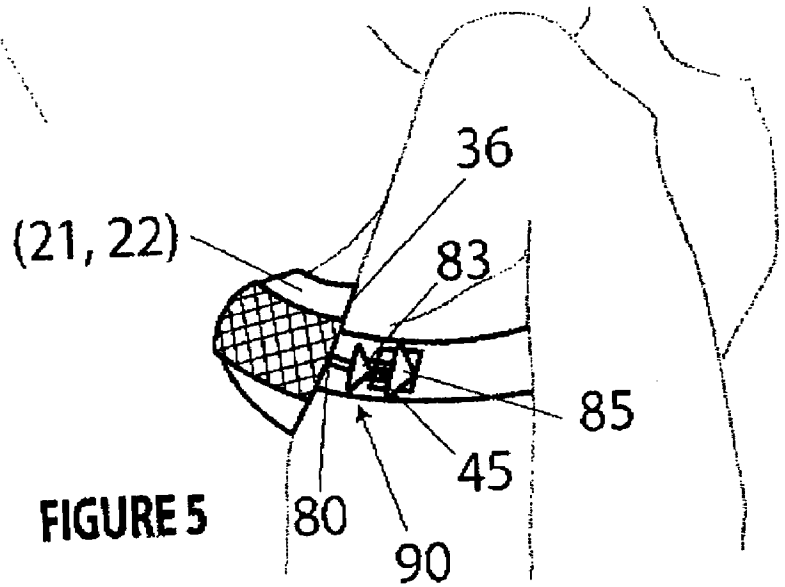
FIG. 5 is a side view of the support bra.

As depicted in FIG. 5, support bra (10) further comprises an adjustment attachment (90) extending laterally from the side edge of each breast cup to the back portion (40). Adjustment attachment (90) further includes a small elastic band (83) having complementary fasteners (80,85) attached to each opposite end. Fasteners (80, 85) can be conventional clamps as shown in FIG. 5. Fastener 80 is attached to the side edge (36) of each breast cup (11,12) and fastener 85 is attached to the side edge 45 of back portion 40. Elastic band (83) stretches to extend-laterally as it adjusts to the circumference of the wearer's chest size and provide greater support.

Figure 6:
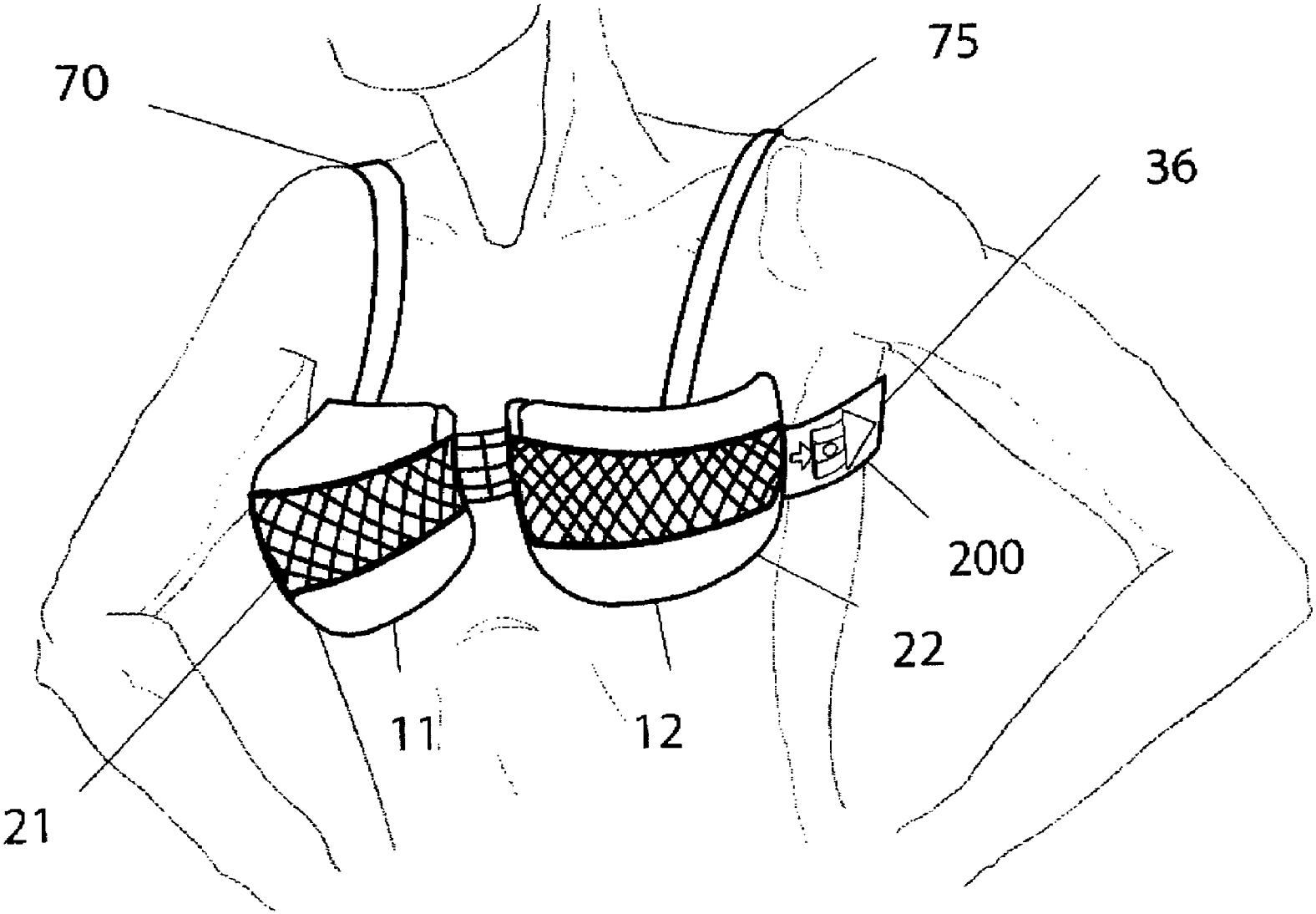
FIG. 6 is a front view of the support bra with shoulder straps

In an alternative embodiment, support bra (10) can have conventional shoulder straps(70, 75) as shown in FIG. 6. Conventional strap (70, 75) respectively connects each breast cup (11, 12) to the upper back portion (40) of support bra (10). When fastening member (20) securely couples breast cup 11 and 12 together, additional lift is provided for the heavy busted woman.

What is claimed is:

1. A breast support apparatus comprising: at least one layered front portion constructed and arranged to form two breast cups, each breast cup having an inner layer abutting the breast during use, each breast cup configured and dimensioned to hold a female breast, each breast cup defined by a mid-section, a lower section, an external surface area, an inner surface area and a side edge;

a support member secured in place to the external surface area of each breast cup, the support member being made of a strong flexible rigid material tat is configured and dimensioned to accommodate at least the lower section of each breast cup;

at least one layered back portion having an inner layer abutting a wearer's upper back area during use, the back portion having a first side edge and an opposing second side edge;

the first side edge of the back portion being attached to the first side edge of a first breast cup and the opposing second side edge of the back portion being attached to the side edge of a second breast cup;

each support member having an outer peripheral edge; and an adjustable means attaching the outer peripheral edge of each support member to the opposing side edge of each back portion such that the support member is adjustable to the breast size and shape of the wearer;

each breast cup contains a padding which is evenly distributed over substantially the entire inner surface area of each breast cup;

the padding is a memory foam material that molds to the shape of the body during movement; and at least one cooperating fastening member attached to an internal peripheral edge proximately near the mid-section of each breast cup such that when the cooperating fastening members are secured the support member uplifts each breast securing the apparatus in place around the wearer's upper back area.

2. The apparatus of claim 1 wherein the back portion further comprises a continuous inner layer evenly distributed over the entire surface area of the back portion.

3. The apparatus of claim 2 wherein the inner layer made of a memory foam material molds to the shape of the body during movement.

4. The apparatus of claim 2 wherein the back portion further comprises:

an inner layer having a plurality of pressure points spanning the area of the inner layer;

each pressure point being formed by a pocket of foam incorporated within the inner layer.

5. The apparatus of claim 4 wherein each pressure point is made of a memory foam material that molds to the shape of the body during movement.

6. The apparatus of claim 1 wherein the rigid material is made of a flexible wire mesh.

7. The apparatus of claim 1 wherein the rigid material is made of a flexible durable lightweight plastic.

8. The apparatus of claim 1 further comprising a pair of shoulder straps interconnecting a top edge each breast cup to a top edge of the back portion.

9. A breast support apparatus comprising: at least one layered front portion constructed to form two breast cups, each breast cup configured and dimensioned to hold a female breast, each breast cup defined by an mid-section, a lower section an external surface area, an inner surface area and a side edge; a support member secured to the inner surface area of each breast cup, the support member being made of a strong flexible rigid material that is configured and dimensioned to accommodate at least the lower section of each breast cup;

at least one continuous layered back portion;

each support member having an outer peripheral edge; and an adjustable means attaching the outer peripheral edge of each support member to the opposing side of each back portion such that the support member is adjustable to the breast size and shave of the wearer;

each breast cup contains a padding which is evenly distributed over substantially the entire inner surface area of each breast cup covering the support member;

the padding is a memory foam material that molds to the shape of the body during movement;

the first side edge of the back portion being attached to the first side edge of a first breast cup and the opposing second side edge of the back portion being attached to the side edge of a second breast cup; and at least one cooperating fastening member attached to an internal peripheral edge proximately near the mid-section of each breast cup such that when the cooperating fastening members are secured the support member uplifts each breast.

10. The apparatus of claim 9 wherein the back portion further comprises an inner layer evenly distributed over an entire surface area of the back portion.

11. The apparatus of claim 10 wherein the inner layer is made of a memory foam material that molds to the shape of the body during movement.

12. The apparatus of claim 10 wherein the inner layer further comprises:

a plurality of pressure points spanning an area of the inner layer; each pressure point being formed by a pocket of foam incorporated within the inner layer.

13. The apparatus of claim 12 wherein each pressure point is made of a memory foam material that molds to the shape of the body during movement.

14. The apparatus of claim 9 further comprising a pair of shoulder straps connecting the top of each breast cup to the top of the back portion.

* * * * *